US006354928B1

(12) United States Patent
Crevasse et al.

(10) Patent No.: US 6,354,928 B1
(45) Date of Patent: Mar. 12, 2002

(54) POLISHING APPARATUS WITH CARRIER RING AND CARRIER HEAD EMPLOYING LIKE POLARITIES

(75) Inventors: Annette M. Crevasse; William G. Easter; John A. Maze; Frank Miceli, all of Orlando, FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/553,938

(22) Filed: Apr. 21, 2000

(51) Int. Cl.[7] ..... B24B 47/02

(52) U.S. Cl. ..... 451/397; 451/11; 451/288; 451/41

(58) Field of Search ..... 451/9, 11, 36, 451/41, 287, 288, 290, 397, 398, 494, 549, 550, 905

(56) References Cited

U.S. PATENT DOCUMENTS 5,624,299 A * 4/1997 Shendon ..... 451/28
5,679,065 A * 10/1997 Henderson ..... 451/290
5,738,574 A * 4/1998 Tolles et al. ..... 451/288
5,803,799 A * 9/1998 Volodarsky et al. ..... 451/288
5,842,912 A * 12/1998 Holzapfel et al. ..... 451/72
6,059,638 A * 5/2000 Crevasse et al. ..... 451/41
6,231,428 B1 * 5/2001 Maloney et al. ..... 451/41
6,234,868 B1 * 5/2001 Easter et al. ..... 451/5

* cited by examiner

*Primary Examiner*—Joseph J. Hail, III
*Assistant Examiner*—David B. Thomas

(57) ABSTRACT

The present invention provides a polishing apparatus comprising a carrier head having a periphery, a first region, a carrier ring, and a second region. The carrier ring is coupled to the periphery. The carrier ring and carrier head are configured to cooperatively receive an object to be polished. The first region is associated with the carrier head and is capable of manifesting a polarity proximate the carrier ring. The second region is associated with the carrier ring and is capable of manifesting the polarity proximate the first region. The first and second regions have like polarities that create a repelling force between the carrier head and the carrier ring.

28 Claims, 3 Drawing Sheets

POLISHING APPARATUS WITH CARRIER RING AND CARRIER HEAD EMPLOYING LIKE POLARITIES

TECHNICAL FIELD OF THE INVENTION

The present invention is directed, in general, to a polishing apparatus and, more specifically, to a magnetic polishing head and retaining ring for polishing semiconductor wafers.

BACKGROUND OF THE INVENTION

In the manufacture of microcircuit dies, chemical/mechanical polishing (CMP) is used to provide smooth topographies of the semiconductor wafers for subsequent lithography and material deposition. Briefly, the CMP process involves holding and rotating a thin, reasonably flat, semiconductor wafer while pressing the wafer against a rotating polishing surface or platen. The semiconductor wafer is held in a carrier that has a carrier ring about its periphery to restrain the wafer to a position under the carrier. The polishing surface is wetted by a chemical slurry, under controlled chemical, pressure, and temperature conditions. The chemical slurry contains selected chemicals which etch or oxidize specific surfaces of the wafer during processing. Additionally, the slurry contains a polishing agent, such as alumina or silica, which is used to abrade the etched/oxidized surfaces. The combination of mechanical and chemical removal of material results in superior planarization of the polished surface.

A polishing pad that rests on the surface of the polishing platen receives and holds the chemical slurry during polishing. Because of the extremely small tolerances necessary in semiconductor manufacture, it is important to maintain the planarity of the wafer.

Referring initially to FIG. 1, illustrated is a simplified, enlarged sectional view of a conventional carrier head and conventional polishing platen during polishing. As shown, a conventional carrier head 100 comprises a carrier body 110, a retaining ring 120, and a pneumatic interface 130. A conventional polishing surface 140 comprises a polishing platen 150, and a polishing pad 160. A semiconductor wafer 170 has a surface 172 being polished. One who is skilled in the art is familiar with the ripple 162 effect on the polishing pad 160 as the carrier head 100, semiconductor wafer 170, polishing platen 150, and polishing pad 160 rotate during polishing. In the illustrated embodiment, the free edge 121 contacted is on the retaining ring 120 that is being forced against the polishing pad 160 by a force 180 generated by the pneumatic interface 130. In addition to retaining the wafer 170 under the carrier head 100, the retaining ring 120 prevents the ripple 162 from contacting an outer edge 173 of the semiconductor wafer 170 and causing nonuniform polishing of the edge of the wafer 170. This nonuniform polishing at the edge 173 is known as the edge effect. As the pad 160 retains polishing slurry 190, any contact of the pad 160 with the wafer 170 will result in material removal from the wafer 170. In order to avoid the edge effect through contact with the ripple 162, the carrier ring 120 is extended toward the polishing pad 160, typically with pneumatic pressure, to cause the ripple 162 to form outward toward the circumference of the carrier ring 120 and away from the wafer 170. That is, a pneumatic interface 130 forces the retaining ring 120 against the pad 160 to form the ripple 162. The pneumatic interface 130 may be a relatively complicated system requiring pneumatic lines, seals and actuators (not shown) to assure the retaining ring 120 remains in contact with the polishing pad 160.

Accordingly, what is needed in the art is a simpler apparatus that eliminates the need to power an electromagnet in the polishing platen while still applying the necessary carrier ring force during chemical/mechanical polishing of semiconductor wafers.

SUMMARY OF THE INVENTION

To address the above-discussed deficiencies of the prior art, the present invention provides a polishing apparatus comprising a carrier head having a periphery, a first region, a carrier ring, and a second region. The carrier ring is coupled to the periphery. The carrier ring and carrier head are configured to cooperatively receive an object to be polished. The first region is associated with the carrier head and is capable of manifesting a polarity proximate the carrier ring. The second region is associated with the carrier ring and is capable of manifesting the same polarity proximate the first region. Therefore, the first and second regions have like polarities that create a repelling force between the carrier head and the carrier ring. The repelling force may be created by like magnetic fields or like electrostatic fields.

Thus, in one aspect, the present invention provides a polishing apparatus that has a polishing mechanism operable on the principles of magnetic or electrostatic forces that can be used to maintain a desired downward polishing force on a wafer.

In another embodiment, the first region is formed in the carrier head and the second region is formed in the carrier ring. The polishing apparatus, in an alternative embodiment, further comprises ring retainers interposed between the carrier head and the carrier ring. The ring retainers are configured to slidably couple the carrier head to the carrier ring.

In other embodiments, at least one of the first or second regions is a permanent magnetic region, a soft magnetic region, or an electromagnetic region. In a further aspect of this embodiment, the repelling force is adjustable by controlling a current in the electromagnetic region.

The polishing apparatus, in another embodiment, further comprises a drive motor coupled to the carrier head and configured to rotate the carrier head and the object, such as a semiconductor wafer. In one aspect of this embodiment, the polishing apparatus further comprises a polishing platen juxtaposed the carrier head and coupled to the drive motor configured to rotate the polishing platen. In an additional aspect, the polishing apparatus further comprises a polishing pad that is coupled to the polishing platen and that is configured to retain a polishing slurry. The polishing apparatus, in an another embodiment, further comprises a slurry delivery system in fluid communication with the polishing platen. The slurry delivery system is configured to deliver the polishing slurry to the polishing pad.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Such pneumatic systems as previously described are not sufficiently precise in their employment for high-precision semiconductor manufacture in sub-quarter micron devices. Efforts to solve the complexity, expense and accuracy problems of the pneumatic systems resulted in an effort to use magnetic forces to control the carrier ring as evidenced in co-pending application Ser. No. 09/237,082, filed Jan. 25, 1999, entitled "Magnetic Force Carrier and Ring for a Polishing Apparatus" commonly assigned with the present application and incorporated herein by reference. However, while technically responsive to solving the problems of pneumatic systems, implementation of the aforementioned application presented a new problem. Specifically, the mass of the polishing platen requires a very significant electrical power draw to create and control a magnetic field in an electromagnet with a mass the size of the semiconductor polishing platen.

Figure 2:
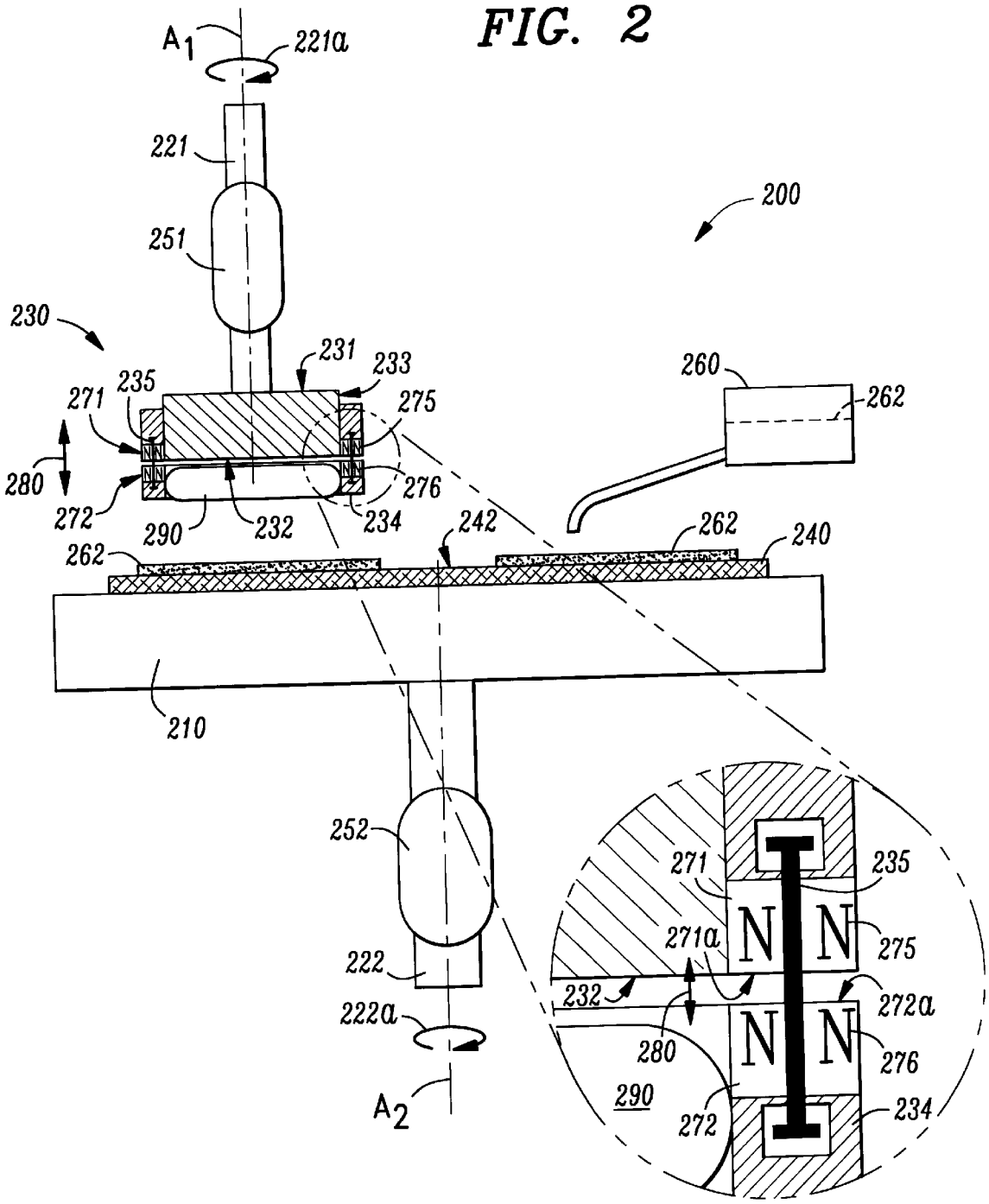
FIG. 2 illustrates a partial sectional view of an exemplary embodiment of a CMP apparatus constructed according to the principles of the present invention.

Referring now to FIG. 2, illustrated is a partial sectional view of an advantageous embodiment of a CMP apparatus constructed according to the principles of the present invention. A CMP apparatus, generally designated 200, comprises a polishing platen 210, first and second rotatable shafts 221, 222, respectively, a carrier head 230, a polishing pad 240 having a polishing surface 242, first and second drive motors 251, 252, respectively; and a slurry reservoir 260 containing slurry 262.

The carrier head 230 preferably comprises first and second opposing faces 231, 232, a periphery 233, a carrier ring 234, ring retainers 235, and first and second regions 271, 272, respectively. The first rotatable shaft 221 has an axis $A_1$, and is coupled to the carrier head 230 at the first opposing face 231. The first drive motor 251 may rotate the first rotatable shaft 221 and the carrier head 230 about axis $A_1$ in direction 221*a*. The first region 271 is located proximate the periphery 233 and has a first polarity 275 proximate the second opposing face 232.

In one embodiment, a surface 271*a* of the first region 271 is configured as a magnetic pole having a first magnetic polarity 275, e.g., a north magnetic pole, as shown. The second region 272 has a second magnetic polarity 276 also proximate the second opposing face 232. First and second regions 271, 272 are capable of manifesting like polarities; that is, the first and second regions 271, 272 exhibit a magnetic characteristic or are regions that are capable of having a polarity induced therein to act as magnetic regions, such as electromagnetic regions.

In the illustrated embodiment, the first region 271 is formed in the carrier head 230 proximate the periphery 233 while the second region 272 is formed in the carrier ring 234. The ring retainers 235 are interposed between the carrier head 230 and the carrier ring 234, thereby allowing the carrier ring 234 to slide up or down with respect to the carrier head 230 without separating from the carrier head 230.

In a preferred embodiment, the first and second polarities 275, 276 are like polarities, e.g., N and N as shown, or alternatively S and S. One who is skilled in the art will readily perceive that such a configuration will create a repelling force 280 between the like polarities 275, 276. The carrier head 230 and the carrier ring 234 cooperate to retain an object 290 during polishing. In one advantageous embodiment, the object 290 is a semiconductor wafer 290. The carrier ring 234 prevents the semiconductor wafer 290 from fleeing the carrier head 230 under the forces of rotation.

The first or second regions 271,272 may be a permanent magnetic regions comprising a material, such as lodestone. Alternatively, one of the regions may be a permanent magnet while the other region may be capable of having an electromagnetic field induced therein. In another embodiment, the first or second magnetic regions 271,272 may be a soft magnetic material, such as dead annealed iron. Of course, the magnetic regions may also be other types of magnetic material such as alnico or rare earth permanent magnets. The first and second regions 271, 272 are configured to manifest like polarities. The exact polarity chosen for the first magnetic region 271 and second magnetic region 272 is not important so long as the regions 271, 272 present like polarities to each other at surfaces 271*a* and 272*a*, which creates the repelling force 280 between the first and second regions 271, 272 and between the carrier head 230 and carrier ring 234.

In another embodiment, the first and second regions 271,272 may be comprised of a material in which like magnetic fields may be created. For example, the like polarities may be created in the first and second regions 271,272 by a current associated with each region. The strength of the repelling force 280 may be changed by changing an electrical current through either or both of the first and second regions 271, 272. By way of example, electromagnetic properties may be induced by a magnetic coil. The magnetic coil may be connected to a power source (not shown) through a rheostat that allows precise control of current flow through the magnetic coil. This provides distinct advantages over conventional polishing apparatuses because the ability to vary the strength of the magnetic field allows the operator to more precisely adjust the repelling force 280. This, in turn, allows an operator to achieve a more accurately polished object 290. The semiconductor wafer 290, by way of the carrier head 230 and the rotatable shaft 221, is engageable against the polishing pad 240. Thus, this particular embodiment is quite useful in the fabrication of integrated circuits formed on semiconductor wafers 290 and devices where material thicknesses have reached critical dimensions that require more accurate polishing techniques.

In an alternative embodiment, the first and second regions 271,272 are electrostatic regions of like charge, such as that created by an applied voltage to these regions. In such embodiments, the repelling force 280 may be controlled by changing a voltage associated with the first and second regions 271,272.

The polishing platen 210 is substantially horizontal and coupled to the second rotatable shaft 222 that has an axis $A_2$, which is also substantially normal to the polishing platen 210. The second rotatable shaft 222 and polishing platen 210 are driven about the axis $A_2$ in direction 222*a* by the second drive motor 252. The polishing platen 210 supports the polishing pad 240 that provides the polishing surface 242 upon which the slurry 262 is deposited and retained and against which the object 290 is planarized.

During polishing, the face 232 of the carrier head 230 and the semiconductor wafer 270 have a common operating angle substantially normal to the rotatable shaft 221; that is, the operating angle is between about 85° and 90° as measured from the axis $A_1$. The rotational axis $A_2$ of the polishing platen 210 and second rotatable shaft 222 is substantially parallel to the axis $A_1$. In a particular aspect of this embodiment, the first rotatable shaft 221 and the second rotatable shaft 222 rotate in the same direction indicated by arrows 221*a*, 222*a*, respectively. However, one who is skilled in the art will readily recognize that directions of rotation of the carrier head 230 and polishing platen 210 do not limit the scope of the present invention. The polishing slurry 262, containing an abrasive, such as silica or alumina particles suspended in either a basic or an acidic solution, is dispensed onto the polishing surface 242 from the temperature controlled slurry reservoir 260.

Figure 3:
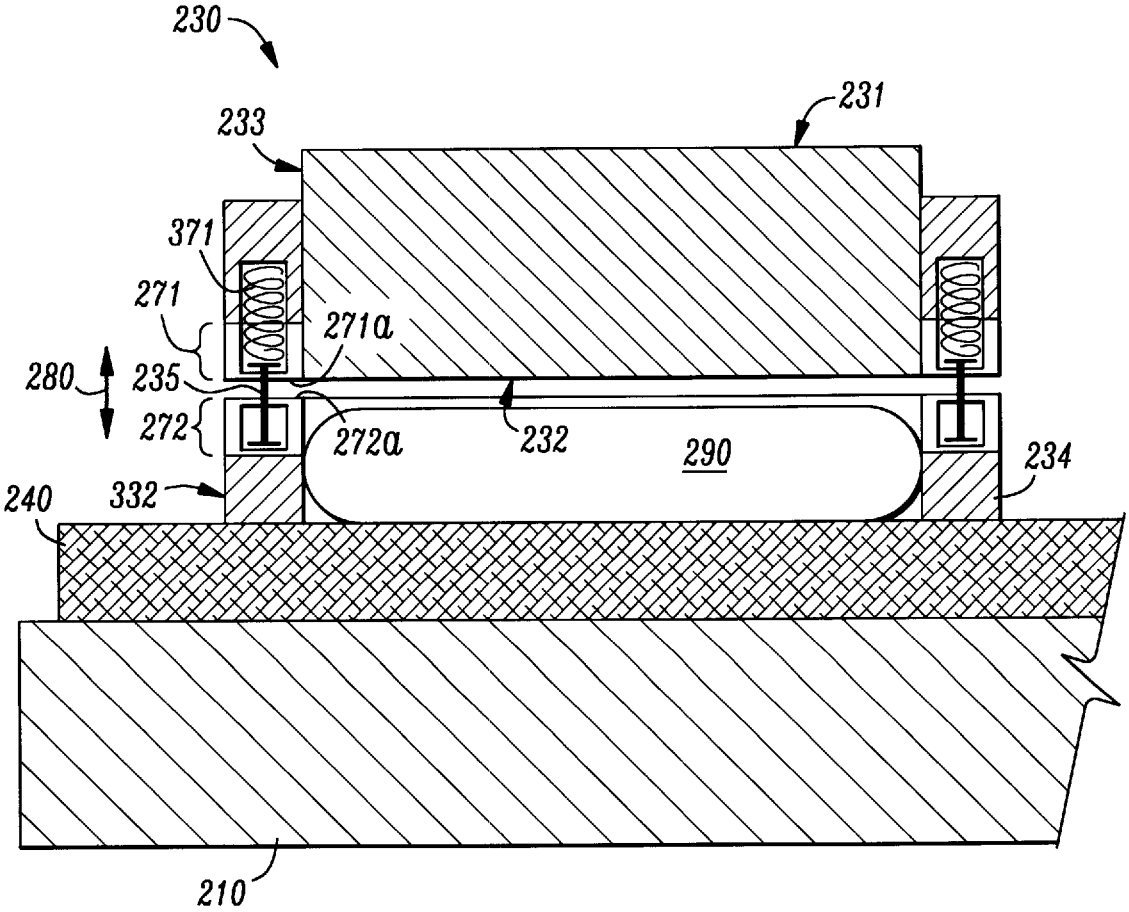
FIG. 3 illustrates an enlarged sectional view of the carrier head of FIG. 2.

Referring now to FIG. 3 with continuing reference to FIG. 2, illustrated is an enlarged sectional view of the carrier head 230 of FIG. 2. In one embodiment, the carrier head 230 comprises the first region 271, the carrier ring 234, and the second region 272 within the carrier ring 234. In this embodiment, an electromagnetic coil 371 is shown that creates the magnetic effect of the first magnetic region 271. In a similar manner, the second magnetic region 272 may be a permanent magnetic region or an electromagnetic region. As previously described, the surface 272*a* of the second magnetic region 272 is of a like magnetic polarity to the surface 271*a*. In this view, the ring retainers 235 may be clearly seen to limit the motion of the carrier ring 234 with respect to the carrier head 230.

Figure 1:
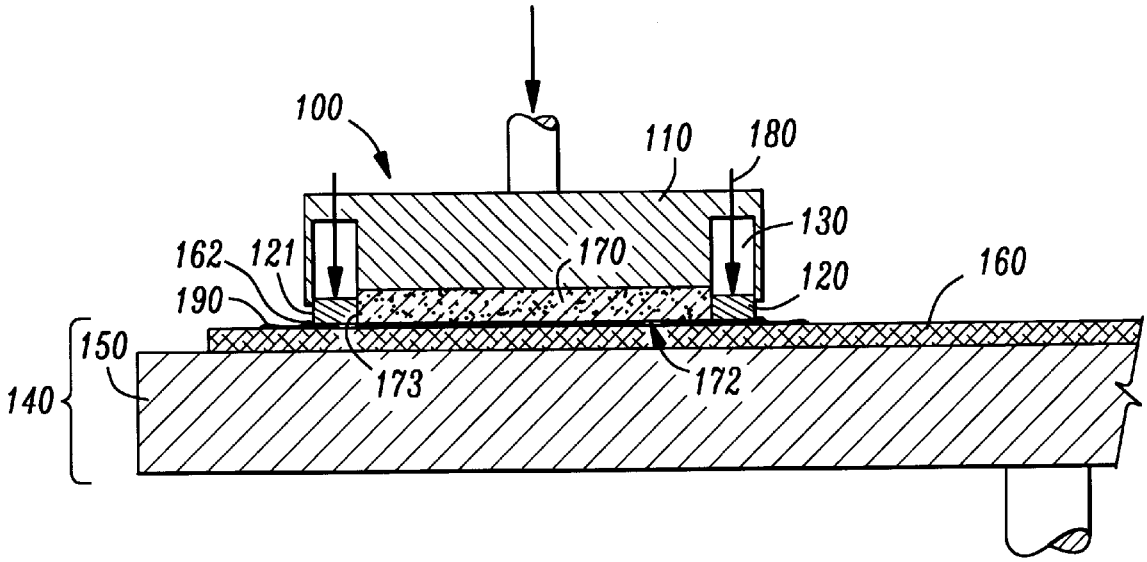
FIG. 1 (PRIOR ART)
FIG. 1 illustrates a simplified, enlarged sectional view of a conventional carrier head and conventional polishing platen during polishing.

Therefore, a carrier ring repelling force 280 may be created between the first and second magnetic regions 271, 272, thereby forcing the carrier ring 234 toward the polishing platen 210 and polishing pad 240. Thus, controlling the vertical position of the retaining ring 234 is simplified by the present invention that can adjust the force 280 by controlling currents in the first or second magnetic regions 271, 272. Providing rotary electrical contacts, a feature well known in the art, and electrical current to the first and second regions 271, 272 is a significantly less difficult engineering problem than the prior art pneumatic system, discussed above in FIG. 1.

The previous discussion has emphasized the advantageous use of electromagnetic regions for the purposes of the disclosed invention. However, one who is skilled in the art will readily conceive of other types of electromagnetic, permanent magnetic, electrostatic, and soft magnetic regions to accomplish the same purposes while remaining within the broadest scope of the present invention.

Refer now simultaneously to FIGS. 2 and 3. To polish a semiconductor wafer 290, the wafer 290 is placed under the carrier head 230 and within the retaining ring 234. With a slurry 262 applied to the polishing pad 240, the carrier head 230 and polishing platen 210 are rotated as indicated at 221*a* and 222*a*. Electric current is fed to at least the first electromagnetic region 271 creating a like magnetic polarity as in the second magnetic region 272. Therefore, a downward force 280 of the carrier ring 234 against the polishing pad 240 at the outermost edge 332 of the retaining ring 234 and protecting the semiconductor wafer 290.

Thus, a carrier head 230 incorporating two magnetic, electromagnetic, or electrostatic regions 271, 272, respectively, has been described. The two regions 271, 272 cooperate to provide an electrically adjustable force 280 on the carrier ring 234 between the carrier head 230 and the polishing pad 240. This adjustable force 280 may be more precisely controlled than that provided by the pneumatic apparatus of prior art by controlling a current in the regions 271, 272 within the carrier head 230 and the carrier ring 234, respectively. Using a magnetic force simplifies the design of the retaining ring 234 by eliminating the pneumatic system of one form of the prior art. Other forms of the prior art involve using manually placed shims or other labor-intensive techniques that are similarly eliminated by the present invention.

Although the present invention has been described in detail, those skilled in the art should understand that they can make various changes, substitutions and alterations herein without departing from the spirit and scope of the invention in its broadest form.

What is claimed is:

1. A polishing apparatus, comprising:

a carrier head having a periphery;

a carrier ring coupled to the periphery, the carrier ring and the carrier head configured to cooperatively receive an object to be polished;

a first region associated with the carrier head and capable of manifesting a polarity proximate the carrier ring; and a second region associated with the carrier ring and capable of manifesting the polarity proximate the first region, the first and second regions having like polarities that create a repelling force between the object carrier and the carrier ring.

2. The polishing apparatus as recited in claim 1 wherein the first region is an electrostatic region formed in the carrier head and the second region is also an electrostatic region formed in the carrier ring.

3. The polishing apparatus as recited in claim 1 further comprising ring retainers interposed between the carrier head and the carrier ring, the ring retainers configured to slidably couple the carrier head to the carrier ring.

4. The polishing apparatus as recited in claim 1 wherein the first and second regions are magnetic regions.

5. The polishing apparatus as recited in claim 4 wherein at least one of the first or second regions is selected from the group consisting of:

a permanent magnetic region;

a soft magnetic region; and an electromagnetic region.

6. The polishing apparatus as recited in claim 5 wherein the first and second regions are electromagnetic regions and the repelling force is adjustable by controlling a current in the first and second electromagnetic regions.

7. The polishing apparatus as recited in claim 1 further comprising a drive motor coupled to the carrier head, the drive motor configured to rotate the carrier head and the object.

8. The polishing apparatus as recited in claim 7 further comprising a polishing platen juxtaposed the carrier head and coupled to the drive motor, the drive motor configured to rotate the polishing platen.

9. The polishing apparatus as recited in claim 8 further comprising a polishing pad coupled to the polishing platen and configured to retain a polishing slurry.

10. The polishing apparatus as recited in claim 9 further comprising a slurry delivery system in fluid communication with the polishing platen and configured to deliver the polishing slurry to the polishing pad.

11. The polishing apparatus as recited in claim 1 wherein the object is a semiconductor wafer.

12. A method of manufacturing a polishing apparatus, comprising:

forming a carrier head having a periphery;

coupling a carrier ring to the periphery, the carrier ring and the carrier head configured to cooperatively receive an object to be polished;

forming a first region associated with the carrier head, the first region capable of manifesting a polarity proximate the carrier ring; and forming a second region associated with the carrier ring, the second region capable of manifesting the polarity proximate the first region, the first and second magnetic regions having like polarities that create a repelling force between the carrier head and the carrier ring.

13. The method as recited in claim 12 wherein forming a first region includes forming a first electrostatic region in the carrier head and forming a second region includes forming a second electrostatic region in the carrier ring.

14. The method as recited in claim 12 further comprising interposing ring retainers between the carrier head and the carrier ring, the ring retainers configured to slidably couple the carrier head to the carrier ring.

15. The method as recited in claim 12 wherein forming first and second regions includes forming first and second magnetic regions.

16. The method as recited in claim 15 wherein forming a first or second region includes coupling a first or second magnetic regions selected from the group consisting of:

a permanent magnetic region;

a soft magnetic region; and an electromagnetic region.

17. The method as recited in claim 16 wherein coupling a first or second magnetic regions includes creating a variable repelling force that is adjustable by controlling a current in the electromagnetic region.

18. The method as recited in claim 12 further comprising coupling a drive motor to the carrier head, the drive motor configured to rotate the carrier head and the object.

19. The method as recited in claim 18 further comprising coupling a polishing platen to the drive motor, the polishing platen juxtaposed the carrier head, and the drive motor configured to rotate the polishing platen.

20. The method as recited in claim 19 further comprising coupling a polishing pad to the polishing platen, the polishing pad configured to retain a polishing slurry.

21. The method as recited in claim 20 further comprising coupling a slurry delivery system in fluid communication to the polishing platen, the slurry delivery system configured to deliver the polishing slurry to the polishing pad.

22. The method as recited in claim 12 wherein forming a carrier head includes forming a carrier head configured to receive a semiconductor wafer.

23. A polishing apparatus, comprising:

a carrier head having a periphery;

a carrier ring coupled to the periphery, the carrier ring and the carrier head configured to cooperatively receive an object to be polished;

a first region associated with the carrier head capable of manifesting a polarity proximate the carrier ring; and a second region associated with the carrier ring proximate the first region and capable of manifesting said polarity to generate a repelling force between the object carrier and the carrier ring, which repelling force may be adjusted by varying a voltage applied to the first and second regions.

24. The polishing apparatus as recited in claim 23 further comprising ring retainers interposed between the carrier head and the carrier ring, the ring retainers configured to slidably couple the carrier head to the carrier ring.

25. The polishing apparatus as recited in claim 23 further comprising a drive motor coupled to the carrier head, the drive motor configured to rotate the carrier head an d the object.

26. The polishing apparatus as recited in claim 25 further comprising a polishing platen juxtaposed the carrier head and coupled to the drive motor, the drive motor configured to rotate the polishing platen.

27. The polishing apparatus as recited in claim 26 further comprising a polishing pad coupled to the polishing platen and configured to retain a polishing slurry.

28. The polishing apparatus as recited in claim 27 further comprising a slurry delivery system in fluid communication with the polishing platen and configured to deliver the polishing slurry to the polishing pad.

* * * * *